US012331602B2

(12) United States Patent
Yin et al.

(10) Patent No.: US 12,331,602 B2
(45) Date of Patent: Jun. 17, 2025

(54) WELL-KILLING SYSTEM FOR ULTRA-DEEP WELL DRILLING WITH CO-EXISTENCE OF OVERFLOW AND LOST CIRCULATION AND OPERATION METHOD THEREOF

(71) Applicant: CHINA UNIVERSITY OF PETROLEUM (EAST CHINA), Dongying (CN)

(72) Inventors: Bangtang Yin, Dongying (CN); Kai Feng, Dongying (CN); Baojiang Sun, Dongying (CN); Zhiyuan Wang, Dongying (CN); Yonghai Gao, Dongying (CN); Hao Li, Dongying (CN); Jianbo Zhang, Dongying (CN); Guizhen Xin, Dongying (CN)

(73) Assignee: CHINA UNIVERSITY OF PETROLEUM (EAST CHINA), Dongying (CN)

( * ) Notice: Subject to any disclaimer, the term of this patent is extended or adjusted under 35 U.S.C. 154(b) by 0 days.

(21) Appl. No.: 18/981,584

(22) Filed: Dec. 15, 2024

(65) Prior Publication Data

US 2025/0116163 A1 Apr. 10, 2025

(30) Foreign Application Priority Data

Apr. 30, 2024 (CN) ..... 202410536527.X

(51) Int. Cl.
*E21B 21/08* (2006.01)
*E21B 21/10* (2006.01)

(52) U.S. Cl.
CPC ..... *E21B 21/08* (2013.01); *E21B 21/106* (2013.01)

(58) Field of Classification Search
CPC ..... E21B 21/08; E21B 21/106
See application file for complete search history.

(56) References Cited

U.S. PATENT DOCUMENTS

| | | | | |
|---|---|---|---|---|
| 2019/0078426 | A1* | 3/2019 | Zheng | E21B 44/00 |
| 2023/0038120 | A1* | 2/2023 | Alkhuwayr | E21B 21/085 |
| 2023/0235635 | A1 | 7/2023 | Li et al. | |

FOREIGN PATENT DOCUMENTS

| | | | |
|---|---|---|---|
| CN | 110118069 | A | 8/2019 |
| CN | 114526025 | A | 5/2022 |
| CN | 117803380 | A | 4/2024 |

OTHER PUBLICATIONS

Hui Chen et al., "Application of Coiled Tubing on Small Hole High Pressure Gas Well in Iran", Foreign Oil Field Engineering, Jun. 20, 2010, vol. 26, No. 6, pp. 50-52.

* cited by examiner

*Primary Examiner* — Dany E Akakpo

(57) ABSTRACT

A well-killing system for ultra-deep well drilling with co-existence of overflow and lost circulation is provided. An upper part of a wellhead blowout preventer is connected to a first mud pump and a lost circulation material mud tank through a pipeline, a first three-way control valve, and a second three-way control valve. A lower port of the second three-way control valve is connected to a second mud pump and a mud pit. A lower port of the first three-way control valve is connected to a first well-killing fluid tank and a second well-killing fluid tank. A gas-liquid separation tank is connected to a side of a wellhead device. A first pressure sensor and a first flowmeter are provided on a left port of the first three-way control valve. A second pressure sensor and a second flowmeter are provided at a left port of a third three-way control valve.

6 Claims, 2 Drawing Sheets

WELL-KILLING SYSTEM FOR ULTRA-DEEP WELL DRILLING WITH CO-EXISTENCE OF OVERFLOW AND LOST CIRCULATION AND OPERATION METHOD THEREOF

CROSS-REFERENCE TO RELATED APPLICATIONS

This application claims the benefit of priority from Chinese Patent Application No. 202410536527.X, filed on Apr. 30, 2024. The content of the aforementioned application, including any intervening amendments thereto, is incorporated herein by reference in its entirety.

TECHNICAL FIELD

This application relates to oil drilling, and more particularly to a well-killing system for ultra-deep well drilling with co-existence of overflow and lost circulation and an operation method thereof.

BACKGROUND

At present, main methods to deal with coexistence of overflow and lost circulation include engineer's method (waiting-weighting method), bullheading method and alternate application of throttling circulation and bullheading. However, these methods have their respective advantages and disadvantages. For example, in the case of small loss rate, the engineer's method has a relatively small casing pressure but large time consumption during the well killing process; the bullheading method can shorten the well-killing time, but the higher casing pressure may exceed the wellhead's bearing capacity and lead to the failure of well-killing; and the alternate application of throttling circulation and bullheading can not only reduce the casing pressure but also shorten the well-killing time, but it is difficult to determine when to perform switching between the throttling circulation and bullheading. In the case of a large loss rate, the drilling fluid will experience serious loss during the well-killing process, and the delayed drilling fluid preparation will easily cause that the circulation cannot be established in the annulus. In this case, it is necessary to use the "Hang's mudding-off" technique to back-inject the drilling fluid in the annulus to keep the integrity of the fluid column in the wellbore or perform grouting plugging to plug the leakage layer.

To sum up, it is a complicated challenge to deal with the coexistence of overflow and lost circulation. On one hand, the treatment process has complicated operation and slow switching speed between different processes, where the involved processes include the normal drilling, the engineer's method, the bullheading method, and the alternating application of throttling circulation and bullheading, "Hang's mudding-off", and plugging. On the other hand, the treatment method struggles with large consumption of drilling fluid, delayed drilling fluid preparation, insufficient pressure of the mud pump, and delayed switching between throttling circulation and bullheading.

SUMMARY

In view of the deficiencies in the prior art, this application provides a rapid well-killing system for ultra-deep well drilling with co-existence of overflow and lost circulation and an operation method thereof, which can realize rapid treatment of the complex co-existence of overflow and lost circulation during the ultra-deep well drilling by combining a variety of treatment processes to ensure the safe deep and ultra-deep well drilling.

Technical solutions of this application are described as follows.

This application provides a well-killing system for ultra-deep well drilling with co-existence of overflow and lost circulation, comprising:

a wellhead blowout preventer, a mud pit, a freshwater tank, a mud material tank, and a mud preparation tank; and a first pressure sensor, a first three-way control valve, a second three-way control valve, a first mud pump, a second mud pump, a lost circulation material mud tank, a third three-way control valve, a third mud pump, a first well-killing fluid tank, a second well-killing fluid tank, a second pressure sensor, a first flowmeter, a second flowmeter, a fourth three-way control valve, a gas-liquid separation tank, and a computer terminal;

the wellhead blowout preventer is provided on an upper side of a wellhead device; and the mud pit, the freshwater tank, the mud material tank and the mud preparation tank are provided outside the wellhead;

an upper part of the wellhead blowout preventer is connected to a first port of the first three-way control valve through a first pipeline; a second port of the first three-way control valve is connected to a first port of the second three-way control valve through a second pipeline; a second port of the second three-way control valve is connected to the first mud pump and the lost circulation material mud tank through a third pipeline; a third port of the second three-way control valve is connected to the second mud pump and the mud pit through a fourth pipeline; a third port of the first three-way control valve is connected to a first port of the third three-way control valve through a fifth pipeline and a first one-way valve; a second port of the third three-way control valve is connected to the first well-killing fluid tank and the second well-killing fluid tank through a sixth pipeline and the third mud pump; a first port of the fourth three-way control valve is connected to a side of the wellhead device through a seventh pipeline; a second port of the fourth three-way control valve is connected to a third port of the third three-way control valve through an eighth pipeline; a third port of the fourth three-way control valve is connected to the gas-liquid separation tank through a ninth pipeline; a lower end of the gas-liquid separation tank is connected to the mud preparation tank through a tenth pipeline; an upper end of the mud preparation tank is connected to the freshwater tank and the mud material tank through an eleventh pipeline; the first pressure sensor and the first flowmeter are provided at the first pipeline; the second pressure sensor and the second flowmeter are provided at the seventh pipeline; and the first pressure sensor, the first flowmeter, the second pressure sensor and the second flowmeter are connected to the computer terminal via a first data cable, respectively.

In an embodiment, an outer side of the mud pit is connected to a first end of a second one-way valve via a twelfth pipeline; a second end of the second one-way valve is connected to the mud preparation tank via a thirteenth pipeline and a fourth mud pump; an outer side of the first well-killing fluid tank and an outer side of the second well-killing fluid tank are connected to a first end of a third one-way valve through a fourteenth pipeline; and a second end of the third one-way valve is connected to the mud preparation tank through a fifteenth pipeline and the fourth mud pump.

In an embodiment, a throttle valve is provided at the seventh pipeline.

In an embodiment, a booster pump is provided on the sixth pipeline between the third mud pump and the first well-killing fluid tank.

In an embodiment, a hydrogen sulfide detector is provided on a side of the gas-liquid separation tank; and the hydrogen sulfide detector is connected to the computer terminal via a second data cable.

This application further provides a method for operating the well-killing system above, comprising:

(A) Normal Drilling in a case that an outlet flow rate measured by the second flowmeter and an inlet flow rate measured by the first flowmeter are in a normal state, performing normal drilling through steps of:

turning on the second mud pump and the fourth mud pump through the computer terminal; and opening successively the third port of the second three-way control valve, the second port of the first three-way control valve, the throttle valve, the third port of the fourth three-way control valve, and the second one-way valve, such that a drilling fluid is pumped by the second mud pump from the mud pit to successively flow through the third port of the second three-way control valve, the second port of the first three-way control valve, the first flowmeter, the first pressure sensor, a drilling pipe, and a drilling bit to enter an annulus between a wellbore and the drilling pipe, and then flow successively through the second pressure sensor, the second flowmeter, the throttle valve, the third port of the fourth three-way control valve, the gas-liquid separation tank, and the mud preparation tank to return to the mud pit;

(B) Engineer's Method in a case that the outlet flow rate measured by the second flowmeter is greater than the inlet flow rate measured by the first flowmeter, and the hydrogen sulfide detector does not send an alarm, performing a well killing operation based on an engineer's method through steps of:

turning on the third mud pump and the fourth mud pump through the computer terminal;

opening successively the second port of the third three-way control valve, the first one-way valve, the third port of the first three-way control valve, the throttle valve, the third port of the fourth three-way control valve, and the third one-way valve, such that the drilling fluid is pumped by the third mud pump from the first well-killing fluid tank to flow successively through the second port of the third three-way control valve, the first one-way valve, the third port of the first three-way control valve, the first flowmeter, the first pressure sensor, the drilling pipe, and the drilling bit to enter the annulus between the wellbore and the drilling pipe, and then flow successively through the second pressure sensor, the second flowmeter, the throttle valve, the third port of the fourth three-way control valve, the gas-liquid separation tank, the mud preparation tank, the fourth mud pump, and the third one-way valve to return to the first well-killing fluid tank and the second well-killing fluid tank;

(C) Bullheading Method in a case that the outlet flow rate measured by the second flowmeter is greater than the inlet flow rate measured by the first flowmeter, and the hydrogen sulfide detector sends an alarm, performing a well-killing operation by bullheading through steps of:

turning on the third mud pump and the fourth mud pump through the computer terminal, wherein in the case of insufficient pump pressure, the booster pump is started; and opening successively the third port of the third three-way control valve, the second port of the fourth three-way control valve, the throttle valve, and the third one-way valve; mixing fresh water and raw materials of the drilling fluid in the mud preparation tank to obtain a well-killing liquid, wherein the freshwater is from the freshwater tank, and the raw materials of the drilling fluid are from the mud material tank; pumping, by the fourth mud pump, the well-killing liquid to the first well-killing fluid tank and the second well-killing fluid tank; pumping, by the third mud pump, the well-killing fluid from the first well-killing fluid tank to flow sequentially through the third port of the third three-way control valve, the second port of the fourth three-way control valve, the throttle valve, the second flowmeter, and the second pressure sensor to enter the annulus between the wellbore and the drilling pipe, and to be finally pressed into a formation along with gas generated from an overflow and lost circulation co-existence condition;

(D) Alternating Application of Throttling Circulation and Bullheading

In a case that the outlet flow rate measured by the second flowmeter is greater than the inlet flow rate measured by the first flowmeter, well-killing time of the engineer's method is longer, a loss of the drilling fluid in the engineer's method is larger, and a casing pressure measured by the second pressure sensor in the bullheading rises at a higher rate, carrying out a well-killing operation based on alternating application of throttling circulation and bullheading through steps of:

performing the throttling circulation first according to the engineer's method in step (B); when the casing pressure measured by the second pressure sensor shows a downward trend, opening the third port of the third three-way control valve and the second port of the fourth three-way control valve through the computer terminal, and carrying out the bullheading according to step (C); if the casing pressure measured by the second pressure sensor rises too fast (i.e., exceeding 70% of a bearing capacity of the wellhead), opening the first port of the third three-way control valve and the third port of the fourth three-way control valve through the computer terminal, and carrying out the throttling circulation; and alternately performing the bullheading and the throttling circulation as above until the well-killing operation is completed;

(E) "Hang's Mudding-Off" Operation in a case that the outlet flow rate measured by the second flowmeter is zero, which indicates that there is lost circulation, and it fails to establish a normal circulation of the drilling fluid in the annulus between the wellbore and the drilling pipe, performing a "Hang's mudding-off" operation through steps of:

starting the third mud pump through the computer terminal; and opening successively the third port of the third three-way control valve, the second port of the fourth three-way control valve, and the throttle valve, such that the drilling fluid flows sequentially through the third port of the third three-way control valve, the second port of the fourth three-way control valve, the throttle valve, the second flowmeter, and the second pressure sensor to enter the annulus between the wellbore and the drilling pipe to complete the "Hang's mudding-off" operation; and (F) Plugging Operation in a case that it fails to successfully kill a well through the alternating application of throttling circulation and bullheading, performing a plugging operation prior to the well-killing operation through steps of turning on the first mud pump through the computer terminal;

opening successively the second port of the second three-way control valve and the second port of the first three-way control valve; and pumping, by the first mud pump, a lost circulation material from the lost circulation material mud tank into the formation, wherein the lost circulation material flows sequentially through the second port of the second three-way control valve, the second port of the first three-way control valve, the first flowmeter, the first pressure sensor, the drilling pipe, the drilling bit and the annulus between the wellbore and the drilling pipe to enter and plug a leakage layer.

Compared with the prior art, this application has the following beneficial effects.

The well-killing method in this application includes normal drilling, the engineer's method, the bullheading method, alternating application of throttling circulation and bullheading, the "Hang's mudding-off" operation, and plugging operation. The well-killing system and method provided in this application combine the six processes mentioned above. The well-killing system mainly includes two major parts, namely, devices for the six processes and the well-killing control system. Based on the pressure and flow rate data collected, the well-killing control system controls the opening of relevant valves and pumps, thereby realizing the rapid conversion between different treatment processes. This application combines the processes dealing with complex working conditions with coexistence of overflow and lost circulation, which can solve the problems of treatment process recurrence of coexistence of overflow and lost circulation, large consumption of drilling fluid, delayed drilling fluid preparation, insufficient pressure of the mud pump, and delayed switching between throttling circulation and bullheading, thereby guaranteeing safe drilling in deep and ultra-deep layers.

1, overflow layer; 2, leakage layer; 3, wellbore; 4, wellhead blowout preventer; 5, drilling bit; 6, drilling pipe; 7, first pressure sensor; 8, first three-way control valve; 9, second three-way control valve; 10, first mud pump; 11, second mud pump; 12, lost circulation material mud tank; 13, mud pit; 14, second one-way valve; 15, first one-way valve; 16, third three-way control valve; 17, third mud pump; 18, booster pump; 19, first well-killing fluid tank; 20, second well-killing fluid tank; 21, third one-way valve; 22, second pressure sensor; 23, second flowmeter; 24, throttle valve; 25, fourth three-way control valve; 26, hydrogen sulfide detector; 27, gas-liquid separation tank; 28, freshwater tank; 29, mud material tank; 30, mud preparation tank; 31, fourth mud pump; 32, computer terminal; and 33, first flowmeter.

DETAILED DESCRIPTION OF EMBODIMENTS

The present disclosure will be described in detail below in conjunction with the accompanying drawings and embodiments. It should be understood that described below are merely preferred embodiments for illustrating and explaining the present disclosure only, which are not intended to limit the disclosure.

Embodiment 1

Figure 1:
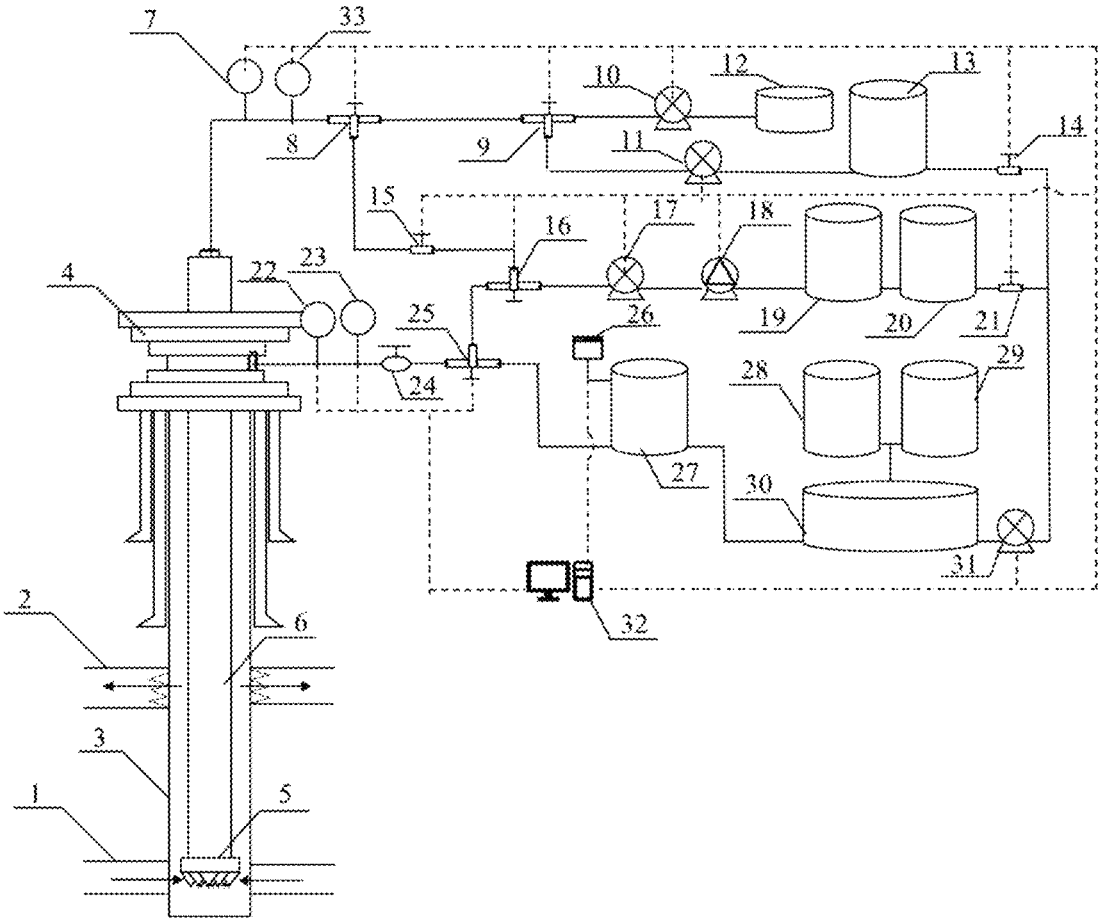
FIG. 1 is a schematic diagram of a rapid well-killing system according to Embodiment 1 of the present disclosure.

As shown in FIG. 1, a rapid well-killing system for ultra-deep well drilling with co-existence conditions of overflow and lost circulation includes a wellhead blowout preventer 4, a mud pit 13, a freshwater tank 28, a mud material tank 29 and a mud preparation tank 30. The wellhead blowout preventer 4 is mounted on the upper side of the wellhead device. The mud pit 13, the freshwater tank 28, the mud material tank 29 and the mud preparation tank 30 are mounted outside the wellhead.

The rapid well-killing system further includes a first pressure sensor 7, a first three-way control valve 8, a second three-way control valve 9, a first mud pump 10, a second mud pump 11, a lost circulation material mud tank 12, a third three-way control valve 16, a third mud pump 17, a first well-killing fluid tank 19, a second well-killing fluid tank 20, a third one-way valve 21, a second pressure sensor 22, a second flowmeter 23, a fourth three-way control valve 25, a gas-liquid separation tank 27, a computer terminal 32, and a first flowmeter 33. The upper part of the wellhead blowout preventer 4 is connected to the left port of the first three-way control valve 8 through a pipeline. The right port of the first three-way control valve 8 is connected to the left port of the second three-way control valve 9 through a pipeline. The right port of the second three-way control valve 9 is connected to the first mud pump 10 and the lost circulation material mud tank 12 through a pipeline. The lower port of the second three-way control valve 9 is connected to the second mud pump 11 and the mud pit 13 via a pipeline. The lower port of the first three-way control valve 8 is connected to the upper port of the third three-way control valve 16 through a pipeline and a first one-way valve 15. The right port of the third three-way control valve 16 is connected to the first well-killing fluid tank 19 and the second well-killing fluid tank 20 through the pipeline and the third mud pump 17. The left port of the fourth three-way control valve 25 is connected to the side of the wellhead device through the pipeline. The upper port of the fourth three-way control valve 25 is connected to the left port of the third three-way control valve 16 via a pipeline. The right port of the fourth three-way control valve 25 is connected to the gas-liquid separation tank 27 through the pipeline. The lower end of the gas-liquid separation tank 27 is connected to the mud preparation tank 30 through the pipeline. The upper end of the mud preparation tank 30 is connected to the freshwater tank 28 and the mud material tank 29 through the pipeline. The first pressure sensor 7 and the first flowmeter 33 are mounted in the pipeline at the left port of the first three-way control valve 8. The second pressure sensor 22 and the second flowmeter 23 are mounted in the pipeline on the left port of the fourth three-way control valve 25. The first pressure sensor 7, the first flowmeter 33, the second pressure sensor 22 and the second flowmeter 23 are connected to the computer terminal 32 via data cables, respectively.

The outer side of the mud pit 13 is connected to a first end of the second one-way valve 14 through the pipeline, and a second end of the second one-way valve 14 is connected to the mud preparation tank 30 through the pipeline and the fourth mud pump 31. The outer side of the first well-killing fluid tank 19 and the outer side of the second well-killing fluid tank 20 are connected to a first end of the third one-way valve 21 through the pipeline. A second end of the third one-way valve 21 is connected to the mud preparation tank 30 through the pipeline and the fourth mud pump 31.

A throttle valve 24 is mounted on the pipeline in the left port of the fourth three-way control valve 25.

A booster pump 18 is mounted on the pipeline between the third mud pump 17 and the first well-killing fluid tank 19.

A hydrogen sulfide detector 26 is installed on one side of the gas-liquid separation tank 27, and the hydrogen sulfide detector 26 is connected to the computer terminal 32 via the data cables.

In addition, the overflow layer 1 is located in the bottom of the wellbore 3, and the leakage layer 2 is located in the middle-lower part of the wellbore 3.

In an embodiment, the wellhead blowout preventer 4 is provided for shutting off the well to prevent oil and gas from spewing out, or is used as a passageway for connecting the wellbore 3 to an external pipeline. The mud pit 13 is used for storing drilling fluids during normal drilling. The gas-liquid separation tank 27 is used to separate gas and drilling fluids circulating from the wellbore 3 in the process of normal drilling and throttling circulation. The freshwater tank 28 is used for storing fresh water for preparing the drilling fluids. The mud material tank 29 is used to store the drilling fluid raw materials for preparing the drilling fluid. The mud preparation tank 30 is used to quickly prepare the drilling fluid. The lost circulation material mud tank 12 is used to store the sealing mud. The pipeline is used to transmit the drilling fluid and the sealing mud throughout the well-killing process.

A method for the above rapid well-killing system includes the following steps (1)-(6).

1. Normal Drilling

In a case that an outlet flow rate measured by the second flowmeter and an inlet flow rate measured by the first flowmeter are in a normal state, normal drilling is performed through the following steps. The second mud pump 11 and the fourth mud pump 31 are turned on through the computer terminal 32. The lower port of the second three-way control valve 9, the right port of the first three-way control valve 8, the throttle valve 24, the right port of the fourth three-way control valve 25 and the second one-way valve 14 are opened in turn. As a result, the drilling fluid is pumped by the second mud pump 11 from the mud pit 13 into the wellbore 3. The drilling fluid flows in turn through the lower port of the second three-way control valve 9, the right port of the first three-way control valve 8, the first flowmeter 33, the first pressure sensor 7, the drilling pipe 6, and the drilling bit 5 to enter the annulus between the wellbore 3 and the drilling pipe 6, and then flow successively through the second pressure sensor 22, the second flowmeter 23, the throttle valve 24, the right port of the fourth three-way control valve 25, the gas-liquid separation tank 27, and the mud preparation tank 30 to return to the mud pit 13.

2. Engineer's Method

In a case that the outlet flow rate measured through the second flowmeter 23 is greater than the inlet flow rate measured through the first flowmeter 33, and the hydrogen sulfide detector 26 does not send an alarm, the well killing operation based on the engineer's method is performed through the following steps. The computer terminal 32 turns on the third mud pump 17 and the fourth mud pump 31. Then, the right port of the third three-way control valve 16, the first one-way valve 15, the lower port of the first three-way control valve 8, the throttle valve 24, the right port of the fourth three-way control valve 25, and the third one-way valve 21 are opened in turn. As a result, the drilling fluid is pumped by the third mud pump 17 into the wellbore 3 from the first well-killing fluid tank 19. Then, the drilling fluid flows in turn through the right port of the third three-way control valve 16, the first one-way valve 15, the lower port of the first three-way control valve 8, the first flowmeter 33, the first pressure sensor 7, the drilling pipe 6, and the drilling bit 5, then enters the annulus between the wellbore 3 and the drilling pipe 6, and then flows successively through the second pressure sensor 22, the second flowmeter 23, the throttle valve 24, the right port of the fourth three-way control valve 25, the gas-liquid separation tank 27, and the mud preparation tank 30, the fourth mud pump 31, and the third one-way valve 21 to return to the first well-killing fluid tank 19 and the second well-killing fluid tank 20.

3. Bullheading Method

In a case that the outlet flow rate measured by the second flowmeter 23 is greater than the inlet flow rate measured by the first flowmeter 33, and the hydrogen sulfide detector 26 sends an alarm, the well-killing operation is performed by bullheading through the following steps. The third mud pump 17 and the fourth mud pump 31 are turned on through the computer terminal 32. In the case of insufficient pump pressure, the booster pump 18 is started. Then, the left port of the third three-way control valve 16, the upper port of the fourth three-way control valve 25, the throttle valve 24, and the third one-way valve 21 are opened in turn. In the process, the fresh water from the freshwater tank 28 and raw materials of the drilling fluid from the mud material tank 29 are fully mixed in the mud preparation tank 30 to achieve rapidly the well-killing fluid. The prepared well-killing fluid is pumped by the fourth mud pump 31 into the first well-killing fluid tank 19 and the second well-killing fluid tank 20, and then the well-killing fluid is pumped by the third mud pump 17 from the first well-killing fluid tank 19 into the wellbore 3. Then, the well-killing fluid flows sequentially through the left port of the third three-way control valve 16, the upper port of the fourth three-way control valve 25, the throttle valve 24, the second flowmeter 23, and the second pressure sensor 22 to enter the annulus of the wellbore 3 and the drilling pipe 6, and to be finally pressed into a formation along with the gas generated by the overflow and lost circulation co-existence condition.

4. Alternating Application of Throttling Circulation and Bullheading

In a case that the outlet flow rate measured through the second flowmeter 23 is greater than the inlet flow rate measured through the first flowmeter 33, the well-killing time of the engineer's method is longer, a loss of the drilling fluid in the engineer's method is larger, and the casing pressure measured by the second pressure sensor 22 in the bullheading method rises at a higher rate, the well-killing operation based on alternating application of throttling circulation and bullheading are carried out through the following steps. Firstly, the throttling circulation is carried out according to the engineer's method in step (2). When the casing pressure measured by the second pressure sensor 22 shows a downward trend, the left port of the third three-way control valve 16 and the upper port of the fourth three-way control valve 25 are opened through the computer terminal 32, the bullheading method is carried out according to step (3). If the casing pressure measured by the second pressure sensor 22 exceeds 70% of a bearing capacity of the wellhead during the bullheading process, open the upper port of the third three-way control valve 16 and the right port of the fourth three-way control valve 25 through the computer terminal 32, and convert to perform throttling circulation. According to the above method, the throttling circulation and the bullheading method are performed alternately until the well-killing operation is completed.

5. "Hang's Mudding-Off" Operation

In a case that the outlet flow rate measured through the second flowmeter 23 is zero, which indicates that there is lost circulation, and it fails to establish a normal circulation of the drilling fluid in the annulus between the wellbore 3 and the drilling pipe 6, it is necessary to re-establish the circulation by performing a "Hang's mudding-off" operation through the following steps. The third mud pump 17 is started through the computer terminal 32, and the left port of the third three-way control valve 16, the upper port of the fourth three-way control valve 25, and the throttle valve 24 are opened in turn, so that the drilling fluid flows sequentially through the left port of the third three-way control valve 16, the upper port of the fourth three-way control valve 25, the throttle valve 24, the second flowmeter 23, and the second pressure sensor 22 in turn, and finally enters the annulus between the wellbore 3 and the drilling pipe 6 to complete the "Hang's mudding-off" operation.

6. Plugging Operation

In a case that it fails to successfully kill a well through the alternating application of throttling circulation and bullheading, the plugging operation is carried out prior to the well-killing operation through the following steps. The first mud pump 10 is turned on through the computer terminal 32. The right port of the second three-way control valve 9 and the right port of the first three-way control valve 8 are opened in turn. During the process, the lost circulation material is pumped by the first mud pump 10 from the lost circulation material mud tank 12 into the formation. The lost circulation material flows sequentially through the right port of the second three-way control valve 9, the right port of the first three-way control valve 8, the first flowmeter 33, the first pressure sensor 7, the drilling pipe 6, the drilling bit 5, and the annulus between the wellbore 3 and the drilling pipe 6 to enter and plug the leakage layer 2.

Embodiment 2

Figure 2:
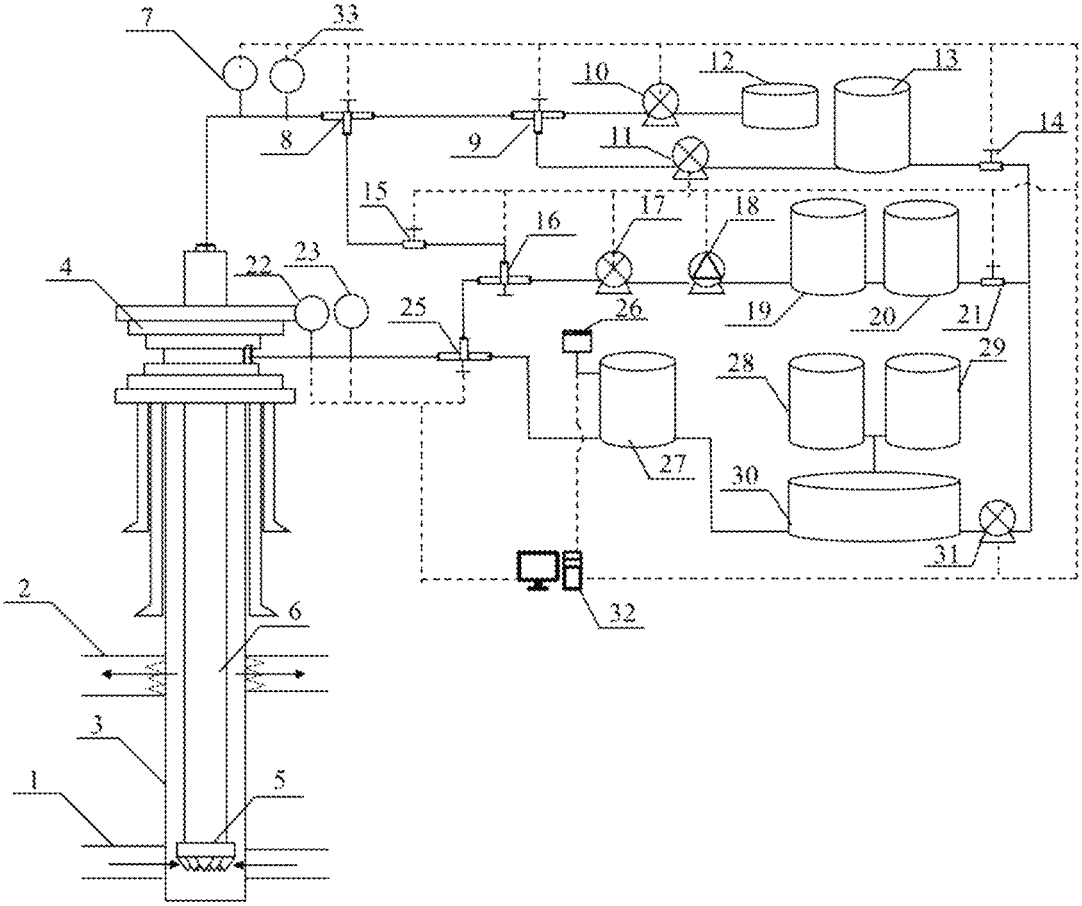
FIG. 2 is a schematic diagram of a rapid well-killing system according to Embodiment 2 of the present disclosure.

Referring to FIG. 2, the rapid well-killing system for ultra-deep well drilling with co-existence conditions of overflow and lost circulation includes a wellhead blowout preventer 4, a mud pit 13, a freshwater tank 28, a mud material tank 29 and a mud preparation tank 30. The wellhead blowout preventer 4 is mounted on the upper side of the wellhead device. The mud pit 13, the freshwater tank 28, the mud material tank 29 and the mud preparation tank 30 are mounted outside the wellhead.

The rapid well-killing system further includes a first pressure sensor 7, a first three-way control valve 8, a second three-way control valve 9, a first mud pump 10, a second mud pump 11, a lost circulation material mud tank 12, a third three-way control valve 16, a third mud pump 17, a first well-killing fluid tank 19, a second well-killing fluid tank 20, a third one-way valve 21, a second pressure sensor 22, a second flowmeter 23, a fourth three-way control valve 25, a gas-liquid separation tank 27, a computer terminal 32, and a first flowmeter 33. The upper part of the wellhead blowout preventer 4 is connected to the left port of the first three-way control valve 8 through a pipeline. The right port of the first three-way control valve 8 is connected to the left port of the second three-way control valve 9 through a pipeline. The right port of the second three-way control valve 9 is connected to the first mud pump 10 and the lost circulation material mud tank 12 through a pipeline. The lower port of the second three-way control valve 9 is connected to the second mud pump 11 and the mud pit 13 through a pipeline. The lower port of the first three-way control valve 8 is connected to the upper port of the third three-way control valve 16 through a pipeline and the first one-way valve 15. The right port of the third three-way control valve 16 is connected to the first well-killing fluid tank 19 and the second well-killing fluid tank 20 through the pipeline and the third mud pump 17. The left port of the fourth three-way control valve 25 is connected to the side of the wellhead device through the pipeline. The upper port of the fourth three-way control valve 25 is connected to the left port of the third three-way control valve 16 via a pipeline. The right port of the fourth three-way control valve 25 is connected to the gas-liquid separation tank 27 through the pipeline. The lower end of the gas-liquid separation tank 27 is connected to the mud preparation tank 30 through a pipeline. The upper end of the mud preparation tank 30 is connected to the freshwater tank 28 and the mud material tank 29 through the pipeline. The first pressure sensor 7 and the first flowmeter 33 are mounted in the pipeline at the left port of the first three-way control valve 8. The second pressure sensor 22 and the second flowmeter 23 are mounted in the pipeline on the left port of the fourth three-way control valve 25. The first pressure sensor 7, the first flowmeter 33, the second pressure sensor 22 and the second flowmeter 23 are connected to the computer terminal 32 via data cables, respectively.

This embodiment differs from embodiment 1 in that the object of the present disclosure can also be achieved by omitting the throttle valve 24 on the pipeline on the left port of the fourth three-way control valve 25.

Described above are merely preferred embodiments of the disclosure, which are not intended to limit the disclosure. It should be understood that any modifications and replacements made by those skilled in the art without departing from the spirit of the disclosure should fall within the scope of the disclosure defined by the appended claims.

What is claimed is:

1. A well-killing system for ultra-deep well drilling with co-existence of overflow and lost circulation, comprising:

a wellhead blowout preventer;
a mud pit;
a freshwater tank;
a mud material tank;
a mud preparation tank;
a first pressure sensor;
a first three-way control valve;
a second three-way control valve;
a first mud pump;
a second mud pump;
a lost circulation material mud tank;
a third three-way control valve;
a third mud pump;

a first well-killing fluid tank;
a second well-killing fluid tank;
a second pressure sensor;
a first flowmeter;
a second flowmeter;
a fourth three-way control valve;
a gas-liquid separation tank; and
a computer terminal;

wherein the wellhead blowout preventer is provided on an upper side of a wellhead device; and the mud pit, the freshwater tank, the mud material tank and the mud preparation tank are provided outside a wellhead;

an upper part of the wellhead blowout preventer is connected to a first port of the first three-way control valve through a first pipeline; a second port of the first three-way control valve is connected to a first port of the second three-way control valve through a second pipeline; a second port of the second three-way control valve is connected to the first mud pump and the lost circulation material mud tank through a third pipeline; a third port of the second three-way control valve is connected to the second mud pump and the mud pit through a fourth pipeline; a third port of the first three-way control valve is connected to a first port of the third three-way control valve through a fifth pipeline and a first one-way valve; a second port of the third three-way control valve is connected to the first well-killing fluid tank and the second well-killing fluid tank through a sixth pipeline and the third mud pump; a first port of the fourth three-way control valve is connected to a side of the wellhead device through a seventh pipeline; a second port of the fourth three-way control valve is connected to a third port of the third three-way control valve through an eighth pipeline; a third port of the fourth three-way control valve is connected to the gas-liquid separation tank through a ninth pipeline; a lower end of the gas-liquid separation tank is connected to the mud preparation tank through a tenth pipeline; an upper end of the mud preparation tank is connected to the freshwater tank and the mud material tank through an eleventh pipeline; the first pressure sensor and the first flowmeter are provided at the first pipeline; the second pressure sensor and the second flowmeter are provided at the seventh pipeline; and the first pressure sensor, the first flowmeter, the second pressure sensor and the second flowmeter are connected to the computer terminal via a first data cable, respectively.

2. The well-killing system of claim 1, wherein an outer side of the mud pit is connected to a first end of a second one-way valve via a twelfth pipeline; a second end of the second one-way valve is connected to the mud preparation tank via a thirteenth pipeline and a fourth mud pump; an outer side of the first well-killing fluid tank and an outer side of the second well-killing fluid tank are connected to a first end of a third one-way valve through a fourteenth pipeline; and a second end of the third one-way valve is connected to the mud preparation tank through a fifteenth pipeline and the fourth mud pump.

3. The well-killing system of claim 2, wherein a throttle valve is provided at the seventh pipeline.

4. The well-killing system of claim 3, wherein a booster pump is provided on the sixth pipeline between the third mud pump and the first well-killing fluid tank.

5. The well-killing system of claim 4, wherein a hydrogen sulfide detector is provided on a side of the gas-liquid separation tank; and the hydrogen sulfide detector is connected to the computer terminal via a second data cable.

6. A method for operating the well-killing system of claim 5, comprising:

(A) in a case that an outlet flow rate measured by the second flowmeter and an inlet flow rate measured by the first flowmeter are in a normal state, performing normal drilling through steps of:

turning on the second mud pump and the fourth mud pump through the computer terminal; and opening successively the third port of the second three-way control valve, the second port of the first three-way control valve, the throttle valve, the third port of the fourth three-way control valve, and the second one-way valve, such that a drilling fluid is pumped by the second mud pump from the mud pit to successively flow through the third port of the second three-way control valve, the second port of the first three-way control valve, the first flowmeter, the first pressure sensor, a drilling pipe, and a drilling bit to enter an annulus between a wellbore and the drilling pipe, and then flow successively through the second pressure sensor, the second flowmeter, the throttle valve, the third port of the fourth three-way control valve, the gas-liquid separation tank, and the mud preparation tank to return to the mud pit;

(B) in a case that the outlet flow rate measured by the second flowmeter is greater than the inlet flow rate measured by the first flowmeter, and the hydrogen sulfide detector does not send an alarm, performing a well killing operation based on an engineer's method through steps of:

turning on the third mud pump and the fourth mud pump through the computer terminal;

opening successively the second port of the third three-way control valve, the first one-way valve, the third port of the first three-way control valve, the throttle valve, the third port of the fourth three-way control valve, and the third one-way valve, such that the drilling fluid is pumped by the third mud pump from the first well-killing fluid tank to flow successively through the second port of the third three-way control valve, the first one-way valve, the third port of the first three-way control valve, the first flowmeter, the first pressure sensor, the drilling pipe, and the drilling bit to enter the annulus between the wellbore and the drilling pipe, and then flow successively through the second pressure sensor, the second flowmeter, the throttle valve, the third port of the fourth three-way control valve, the gas-liquid separation tank, the mud preparation tank, the fourth mud pump, and the third one-way valve to return to the first well-killing fluid tank and the second well-killing fluid tank;

(C) in a case that the outlet flow rate measured by the second flowmeter is greater than the inlet flow rate measured by the first flowmeter, and the hydrogen sulfide detector sends an alarm, performing a well-killing operation by bullheading through steps of:

turning on the third mud pump and the fourth mud pump through the computer terminal, wherein in the case of insufficient pump pressure, the booster pump is started; and opening successively the third port of the third three-way control valve, the second port of the fourth three-way control valve, the throttle valve, and the third one-way valve; mixing fresh water and raw materials of the drilling fluid in the mud preparation tank to obtain a well-killing liquid, wherein the freshwater is from the freshwater tank, and the raw materials of the drilling fluid are from the mud material tank; pumping, by the fourth mud pump, the well-killing liquid to the first well-killing fluid tank and the second well-killing fluid tank; pumping, by the third mud pump, the well-killing fluid from the first well-killing fluid tank to flow sequentially through the third port of the third three-way control valve, the second port of the fourth three-way control valve, the throttle valve, the second flowmeter, and the second pressure sensor to enter the annulus between the wellbore and the drilling pipe, and to be finally pressed into a formation along with gas generated from an overflow and lost circulation co-existence condition;

(D) in a case that the outlet flow rate measured by the second flowmeter is greater than the inlet flow rate measured by the first flowmeter, well-killing time of the engineer's method is longer, a loss of the drilling fluid in the engineer's method is larger, and a casing pressure measured by the second pressure sensor in the bullheading rises at a higher rate, carrying out a well-killing operation based on alternating application of throttling circulation and bullheading through steps of:

performing the throttling circulation first according to the engineer's method in step (B); when the casing pressure measured by the second pressure sensor shows a downward trend, opening the third port of the third three-way control valve and the second port of the fourth three-way control valve through the computer terminal, and carrying out the bullheading according to step (C); if the casing pressure measured by the second pressure sensor rises too fast, opening the first port of the third three-way control valve and the third port of the fourth three-way control valve through the computer terminal, and carrying out the throttling circulation; and alternately performing the bullheading and the throttling circulation as above until the well-killing operation is completed;

(E) in a case that the outlet flow rate measured by the second flowmeter is zero, which indicates that there is lost circulation, and it fails to establish a normal circulation of the drilling fluid in the annulus between the wellbore and the drilling pipe, performing a "Hang's mudding-off" operation through steps of:

starting the third mud pump through the computer terminal; and opening successively the third port of the third three-way control valve, the second port of the fourth three-way control valve, and the throttle valve, such that the drilling fluid flows sequentially through the third port of the third three-way control valve, the second port of the fourth three-way control valve, the throttle valve, the second flowmeter, and the second pressure sensor to enter the annulus between the wellbore and the drilling pipe to complete the "Hang's mudding-off" operation; and (F) in a case that a well is not killed through the alternating application of throttling circulation and bullheading, performing a plugging operation prior to the well-killing operation through steps of turning on the first mud pump through the computer terminal;

opening successively the second port of the second three-way control valve and the second port of the first three-way control valve; and pumping, by the first mud pump, a lost circulation material from the lost circulation material mud tank into the formation, wherein the lost circulation material flows sequentially through the second port of the second three-way control valve, the second port of the first three-way control valve, the first flowmeter, the first pressure sensor, the drilling pipe, the drilling bit and the annulus between the wellbore and the drilling pipe to enter and plug a leakage layer.

* * * * *